United States Patent [19]

White

[11] Patent Number: 5,060,762

[45] Date of Patent: Oct. 29, 1991

[54] PRESSURE INTENSIFIER FOR REPOSITIONING TELESCOPIC PLUNGERS IN SYNCHRONIZED TELESCOPIC CYLINDERS

[75] Inventor: Lawrence E. White, Harrington Park, N.J.

[73] Assignee: Otis Elevator Company, Farmington, Conn.

[21] Appl. No.: 527,905

[22] Filed: May 24, 1990

[51] Int. Cl.[5] ..... B66B 11/04

[52] U.S. Cl. ..... 187/17; 91/168

[58] Field of Search ..... 187/17, 28; 91/168, 91/169, 390, 189 R; 60/405, 403, 428, 459

[56] References Cited

U.S. PATENT DOCUMENTS 4,043,428 8/1977 White et al. ..... 187/17
4,357,995 11/1982 Kappenhagen ..... 187/17

FOREIGN PATENT DOCUMENTS 3835945 1/1990 Fed. Rep. of Germany ..... 187/17
2004248 3/1979 United Kingdom ..... 187/17

*Primary Examiner*—Robert P. Olszewski
*Assistant Examiner*—Kenneth Noland
*Attorney, Agent, or Firm*—Willliam W. Jones

[57] ABSTRACT

The hydraulic elevator system includes a synchronized telescoping cylinder with inner and outer reciprocating plungers mounted in a fixed cylinder. An hydraulic fluid pressure intensifier is connected to the pressure chamber for the outer plunger, and to the pressure chamber for the inner plunger. Solenoid valves control the flow of hydraulic fluid between the pressure intensifier and the two plunger pressure chambers. Switches mounted on the outer plunger control operation of the solenoid valves. When the inner plunger is too low relative to the outer plunger, when the elevator reaches the bottom landing, the pressure intensifier will raise the pressure in the inner plunger pressure chamber to appropriately lift the inner plunger. When the inner plunger is too high relative to the outer plunger, when the elevator reaches the bottom landing, the pressure intensifier will lower the pressure in the inner plunger pressure chamber, thus lowering the inner plunger.

4 Claims, 1 Drawing Sheet

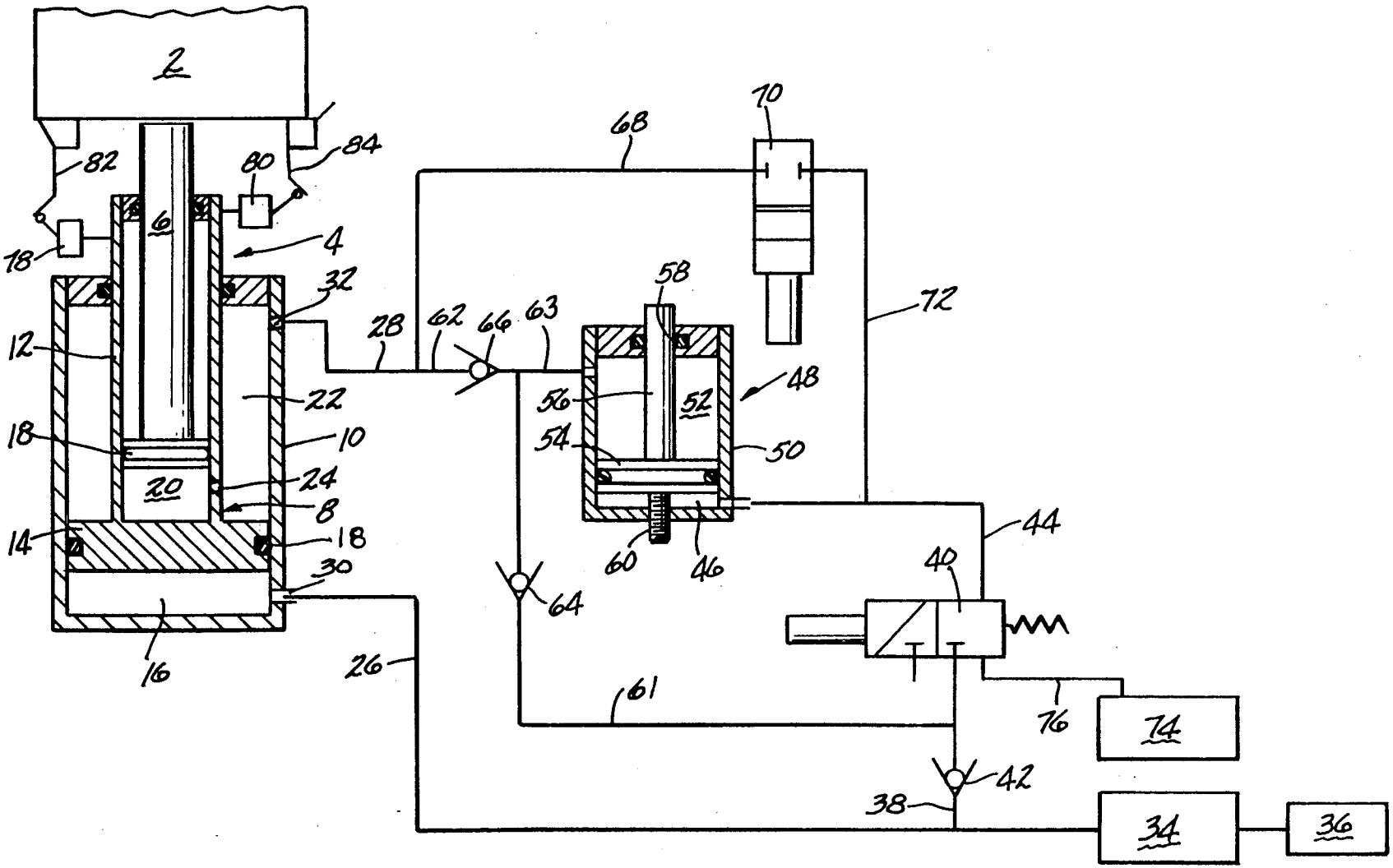
2
4
6
8
10
12
14
16
18
20
22
24
26
28
30
32
34
36
38
40
42
44
46
48
50
52
54
56
58
60
61
62
63
64
66
68
70
72
74
76
80
82
84

PRESSURE INTENSIFIER FOR REPOSITIONING TELESCOPIC PLUNGERS IN SYNCHRONIZED TELESCOPIC CYLINDERS

TECHNICAL FIELD

This invention relates to a telescoping hydraulic cylinder assembly consisting of two or more movable plungers whose movement is automatically synchronized by the hydraulic system. It more particularly relates to the automatic adjustment of the relative position of the multiple moving plungers. This invention was developed for hydraulic elevators but is applicable to any hydraulic system which uses the same type of telescoping cylinder.

BACKGROUND ART

Telescoping cylinders are used in various applications including hydraulic elevators. The principal reason for using telescoping cylinders with multiple plungers is to reduce the overall length of the cylinder assembly. In the case of hydraulic elevators this will allow reduction of the depth of the hole that has to be dug or make the digging of a hole unnecessary permitting installation of a "holeless" hydraulic elevator. One of the problems that has arisen in connection with the hydraulically synchronized telescopic cylinder is that each moving plunger has its own pressure chamber. Internal leakage or volume expansion of the fluid due to heat can result in relative movement of one of the plungers which will reduce the full stroke of movement of the assembly. U.S. Pat. No. 4,043,428, granted Aug. 23, 1977 to Otis Elevator Company, recognizes the aforesaid problem and makes use of a check valve incorporated between two of the pressure chambers. This valve can be opened by removing hydraulic pressure from all parts of the system. This is accomplished by lowering the elevator until all plungers are bottomed. This solution has disadvantages because the correction can only be made by lowering the elevator below the bottom landing. U.S. Pat. No. 4,357,995, granted Nov. 9, 1982 to Westinghouse Electric Corp. also recognizes the problem and provides a second oil pump connected to the inner plunger pressure chamber. When insufficient oil is detected in the pressure chamber, the second pump is activated to replenish the oil supply therein. This solution is undesirable since it cannot correct a condition wherein there is too much oil in the inner plunger pressure chamber.

DISCLOSURE OF THE INVENTION

The system of this invention is able to correct improper positioning of the plungers relative to each other irrespective of whether they are too high or too low. The system utilizes position sensors in the hoistway which detect whether a plunger is too high or too low at the end of a run at the bottom landing. The system includes an automatically operable pressure intensifier which is disposed externally of the telescoping cylinder and which is connected for hydraulic fluid flow with both the inner and outer plunger pressure chambers There are two solenoid valves, one in each line connecting the pressure intensifier with the respective plunger pressure chambers. The plunger position sensors in the hoistway operate the solenoid valves. As long as neither position sensor is improperly positioned, the solenoid valves remain closed and no pressure adjustment is made by the pressure intensifier in either of the plunger pressure chambers. If a position sensor detects improper positioning of the plungers, then the associated solenoid valves will open and hydraulic fluid will flow from the proper plunger pressure chamber in question to one side of the pressure intensifier. The net result will be to either increase the amount of fluid in the internal (high pressure) pressure chamber, and raise the inner plunger if the inner plunger was too low, or to decrease the amount of fluid in the internal (high pressure) plunger pressure chamber, thus lowering the inner plunger if the inner plunger was too high. Since the hydraulic pressure in the inner pressure chamber is higher than the hydraulic pressure in the outer pressure chamber, a pressure intensifier is incorporated as an integral part of the system to raise the pressure from the intensifier to a pressure somewhat higher than the inner pressure chamber pressure to permit transfer of fluid from the outer pressure chamber to the inner pressure chamber.

It is therefore an object of this invention to provide a system for correcting the vertical positions of the plungers in a synchronized telescopic hydraulic cylinder for hydraulic elevators or other equipment.

It is another object of this invention to provide a system of the character described wherein the adjustments are made automatically at the end of a run when high or low positions of the multiple plungers are detected.

BRIEF DESCRIPTION OF THE DRAWING

These and other objects of the invention will become more readily apparent from the following detailed description of a preferred embodiment thereof when taken in conjunction with the accompanying drawing which is a schematic view of the system of this invention.

BEST MODE FOR CARRYING OUT THE INVENTION

Referring to the drawing, the elevator car is denoted generally by the numeral 2. The car 2 is mounted on a telescoping cylinder 4, which includes an inner plunger 6, and an outer plunger 8. The outer plunger 8 is reciprocally mounted in a cylinder 10 disposed in the elevator pit The outer plunger 8 includes a hollow cylindrical part 12 and an enlarged head part 14, the latter of which defines the outer plunger compression chamber 16 at the bottom of the cylinder 10. The inner plunger 6 is slideably disposed in the cylindrical part 12 of the outer plunger 8. A fluid pressure seal 18 separates the outer plunger pressure chamber 16 from the inner plunger pressure chamber 22, which serves as a feed reservoir for pressure chamber 20, which is part of the inner plunger pressure chamber. The passage 24 connects chamber 22 to chamber 20 so that both chambers are at the same pressure and together comprise the inner plunger pressure chamber.

Hydraulic fluid feed lines 26 and 28 connect with the pressure chambers 16 and 22 via passages 30 and 32, respectively. The line 26 is connected to a pump 34 operated by a motor 36, and to a branchline 38 which leads to a three-way solenoid valve 40. The line 38 includes a check valve 42 to prevent flow of fluid from the solenoid valve 40 back to the line 26. A line 44 connects the solenoid valve 40 with the chamber 46 of an hydraulic fluid pressure intensifier 48. The pressure intensifier 48 includes a cylinder 50 which is divided into a chamber 52 and a chamber 46 by a piston 54. Each chamber 46 and 52 is filled with hydraulic fluid.

The piston 54 includes a stem portion 56 extending through a sealed opening 58 in the cylinder 50 whereby the piston 54 is free to move up and down in the cylinder 50. An adjustment member 60 is provided to properly position the piston 54 in the cylinder 50.

Lines 61 and 62 connect the solenoid valve 40 with the inner plunger pressure chamber 20. Check valves 64 and 66 are provided to prevent back flow of fluid through the lines 61 and 62. A line 68 connects a solenoid valve 70 to the inner plunger pressure chamber 22 and 20 via line 28. A line 72 connects the solenoid valve 70 to the line 44 and thus the lower chamber 46 of the pressure intensifier 48. The line 44 connects the line 72 to an hydraulic fluid reservoir 74 via the three-way solenoid valve 40 and a line 76 when the solenoid is deenergized.

A pair of electrical switches 78 and 80 for controlling operation of the solenoid valves 40 and 70 are mounted on the cylindrical part 12 of the inner plunger 8, and a pair of switch cam actuators 82 and 84 are mounted on the car 2 opposite the switches 78 and 80, respectively.

The assembly operates as follows. The positions of the plungers 6 and 12 are adjusted when the car 2 reaches the bottommost floor. When the plungers are properly positioned, the switch actuator 82 will contact the switch 78 and open the latter, and the actuator 84 will be upwardly spaced apart from the switch 80 so that the switch 80 remains open. Thus the switch 78 is normally closed while the switch 80 is normally open. With both switches 78 and 80 open, both solenoid valves 40 and 70 will be deenergized, and nothing will happen.

If the inner plunger 6 is too low in relation to the outer plunger 8 when the car 2 reaches the bottom landing, the actuator 84 will engage the switch 80 to close the latter. The solenoid valve 40 will then be energized to connect line 26 with lines 38 and 44, thereby connecting the outer plunger pressure chamber 16 with the chamber 46 in the pressure intensifier 48. The chambers 16 and 46 will thus have equal pressures. Since the piston head area above the intensifier piston 54 is smaller than the piston head area below the intensifier piston 54 due to the stem 56, the force created on the piston 54 by the pressure in the chamber 46 will create a higher pressure in the upper chamber 52 of the intensifier 48. This will cause fluid to flow from the chamber 52 to the inner plunger pressure chamber 20 via lines 62 and 28, and feed reservoir 22. The intensifier 48 will thus continue to cause fluid flow to the inner plunger pressure chamber 20 whereby the inner plunger 6 will rise sufficiently to disengage the actuator 84 from the switch 80 thereby deenergizing the solenoid valve 40. Fluid then flows from line 26 through line 38, check valve 42, line 61, check valve 64 and line 63 into the chamber 52 of the intensifier 48. This causes the piston 54 to retract forcing fluid out of the chamber 46 and through lines 44 and 76 to the reservoir 74. It will be noted that when the solenoid valve 40 is deenergized a connection is established between lines 44 and 76. At this point the plungers are properly adjusted and are ready for subsequent repositioning should the need arise.

In the event that the inner plunger 6 is too high relative to the outer plunger 12 when the car 2 reaches the bottom landing, the actuator 82 will not be able to engage the switch 78, whereby the latter will close. This will energize the solenoid valves 40 and 70. When valve 70 is energized, fluid can flow from the reservoir 22 through lines 28 and 68 to the intensifier chamber 46. This will create a pressure differential between the chambers 46 and 52 thus causing the intensifier piston 54 to force fluid out of the chamber 52 and into the line 68 through check valve 66 and line 62. A net withdrawal of fluid from the inner plunger pressure chamber 20 and reservoir 22 will result whereby the inner plunger 6 will retract. The plungers will now be positioned so that actuator 82 will contact switch 78 when the car is at the bottom landing insuring that both solenoids 70 and 40 will be deenergized. It will be noted that the excess fluid withdrawn from the chamber 20 and reservoir 22 will flow to the pump reservoir 74 through lines 44 and 76 via the solenoid 40. After the solenoids have deenergized, fluid from the pressure chamber 16 will flow into the intensifier chamber 52 and retract the intensifier piston 54 as previously explained. The mispositioning of the plungers will always be detected at the bottom landing and the corrections, as described, can either be made at the bottom landing or during the next up-run of the elevator.

It will be readily appreciated that the system of this invention operates automatically to adjust the position of the plungers if mispositioning is detected. The adjustment can be made in either direction, i.e., up or down. The system makes the adjustments either when the car is at the bottom landing or during an up-run, thereby minimizing passenger awareness of the adjustment. The active adjustment components of the system are located exteriorly of the telescoping cylinder, and thus are readily accessible to service and inspection.

Since many changes and variations of the disclosed embodiment of the invention may be made without departing from the inventive concept, it is not intended to limit the invention except as required by the appended claims.

What is claimed is:

1. A system for automatically adjusting inner and outer plunger components in a synchronized telescopic plunger assembly, said system comprising:

(a) a cylinder for containing the outer plunger component;

(b) a first pressure chamber in said cylinder for receiving pressurized fluid for extending said outer plunger from said cylinder;

(c) a second pressure chamber in said cylinder and said outer plunger for receiving pressurized fluid for extending said inner plunger from said outer plunger and said cylinder;

(d) a pressure intensifier having two opposed pressure chambers separated by a pressurizing piston;

(e) means connecting said second pressure chamber with each of said pressure intensifier pressure chambers for fluid flow therebetween; and (f) fluid flow control means including means for sensing an abnormal fully-retracted position of said inner plunger component relative to the outer plunger component, said control means being alternatively operable to cause fluid flow from said second pressure chamber to one of said pressure intensifier pressure chambers to selectively retract said inner plunger component into said outer plunger component or to cause fluid flow to said second pressure chamber from the other of said pressure intensifier pressure chambers to selectively extend said inner plunger component from said outer plunger component, whereby said inner plunger component will be properly repositioned relative to said outer plunger component irrespective of whether said inner and outer plungers are too high or too low relative to each other.

2. The system of claim 1 wherein said control means includes sensor means for sensing the position of said inner plunger component relative to said outer plunger component, and valve means operably connected to said sensor means for controlling flow of fluid between said second pressure chamber and said pressure intensifier pressure chambers when abnormal positioning of said inner plunger component is sensed.

3. The system of claim 1 further comprising means connecting said first pressure chamber with said other of said pressure intensifier pressure chambers to cause fluid flow from said first pressure chamber to said other pressure intensifier pressure chamber to activate fluid flow from said first pressure intensifier pressure chamber to said second pressure chamber.

4. The system of claim 2 wherein said plunger assembly is a component of an hydraulic elevator assemblage comprising an elevator car operably connected to said inner plunger component, and wherein said sensor means includes engageable means on said elevator car and said outer plunger component operable to measure the distance between the elevator car and said outer plunger component when the elevator car is at a lowermost landing.

* * * * *